US011015600B2

(12) United States Patent
Tatsuwaki et al.

(10) Patent No.: US 11,015,600 B2
(45) Date of Patent: May 25, 2021

(54) SCROLL COMPRESSOR HAVING SUB-DISCHARGE PORT WITH INVOLUTE-SHAPED OPENING

(71) Applicant: Mitsubishi Electric Corporation, Tokyo (JP)

(72) Inventors: Kohei Tatsuwaki, Tokyo (JP); Tomokazu Matsui, Tokyo (JP); Shuhei Koyama, Tokyo (JP); Yuji Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 315 days.

(21) Appl. No.: 15/781,800

(22) PCT Filed: Feb. 10, 2016

(86) PCT No.: PCT/JP2016/054036
§ 371 (c)(1),
(2) Date: Jun. 6, 2018

(87) PCT Pub. No.: WO2017/138131
PCT Pub. Date: Aug. 17, 2017

(65) Prior Publication Data
US 2018/0363649 A1 Dec. 20, 2018

(51) Int. Cl.
*F04C 18/02* (2006.01)
*F04C 28/26* (2006.01)
*F04C 29/12* (2006.01)

(52) U.S. Cl.
CPC ..... *F04C 18/0261* (2013.01); *F04C 18/0215* (2013.01); *F04C 28/26* (2013.01); *F04C 29/128* (2013.01); *F04C 2210/268* (2013.01)

(58) Field of Classification Search
CPC ..... F04C 18/0215; F04C 18/0292; F04C 2210/268; F04C 2240/50; F04C 28/26;
(Continued)

(56) References Cited

U.S. PATENT DOCUMENTS 5,340,292 A * 8/1994 Steele ..... F04C 29/0035 418/55.1
8,408,888 B2 * 4/2013 Nishikawa ..... F04C 23/008 418/15
(Continued)

FOREIGN PATENT DOCUMENTS

JP 62-157288 7/1987
JP 2007-170253 A 7/2007
(Continued)

OTHER PUBLICATIONS

International Search Report ("ISR") dated May 17, 2016 issued in corresponding international patent application No. PCT/JP2016/054036.

*Primary Examiner* — Mary Davis
*Assistant Examiner* — Paul W Thiede
(74) *Attorney, Agent, or Firm* — Posz Law Group, PLC

(57) ABSTRACT

A scroll compressor including an orbiting scroll and a fixed scroll. A compression chamber is formed by combining a fixed-scroll volute of the fixed scroll and an orbiting-scroll volute of the orbiting scroll. Each of sub-discharge ports of the fixed scroll brings any one of a first compression chamber and a second compression chamber of a compression chamber, the first compression chamber being defined by an inward-facing surface of the fixed-scroll volute and an outward-facing surface of the orbiting-scroll volute, the second compression chamber being defined by an outward-facing surface of the fixed-scroll volute and an inward-facing surface of the orbiting scroll volute, and a discharge side into communication with each other.

11 Claims, 5 Drawing Sheets

(58) Field of Classification Search
CPC ..... F04C 29/128; F04C 23/008; F04C 28/16; F04C 18/02; F04C 29/12
USPC ..... 418/15, 55.1–55.6, 57, 270; 417/301, 417/307, 308, 310, 410.5, 440
See application file for complete search history.

(56) References Cited

U.S. PATENT DOCUMENTS

| | | | | |
|---|---|---|---|---|
| 2010/0303659 | A1* | 12/2010 | Stover | F04C 23/008 418/24 |
| 2013/0251576 | A1* | 9/2013 | Hirata | F04C 18/0284 418/55.4 |
| 2016/0003247 | A1* | 1/2016 | Matsumura | F04C 18/0215 417/410.5 |

FOREIGN PATENT DOCUMENTS

| | | | |
|---|---|---|---|
| JP | 2008-121445 | A | 5/2008 |
| JP | 2011-127435 | A | 6/2011 |
| JP | 2011-149376 | A | 8/2011 |
| JP | 2016-003645 | A | 1/2016 |

* cited by examiner

SECTIONAL VIEW TAKEN ALONG LINE A-A

SCROLL COMPRESSOR HAVING SUB-DISCHARGE PORT WITH INVOLUTE-SHAPED OPENING

CROSS REFERENCE TO RELATED APPLICATION

This application is a U.S. national stage application of PCT/JP2016/054036 filed on Feb. 10, 2016, the contents of which are incorporated herein by reference.

TECHNICAL FIELD

The present invention relates to a scroll compressor to be used for refrigeration and air-conditioning, and more particularly, to a scroll compressor which is supposed to be operated in a wide range of compression ratio and a wide range of rotation speed as in an air-conditioning use.

BACKGROUND ART

In scroll compressors, a built-in volume ratio is determined in accordance with volute specifications. In general, an improper compression loss is not caused under an operating condition in which a proper compression ratio accords with the built-in volume ratio; however, an over-compression loss is caused under an operating condition in which the compression ratio is smaller than the built-in volume ratio, and an insufficient compression loss is caused under an operating condition in which the compression ratio is greater than the built-in volume ratio.

Therefore, generally, the scroll compressors adopt volute specifications for a built-in volume ratio according with an operating condition which is to be considered as the most important one of operating conditions such as rated conditions and an operating frequency. Under a condition other than a condition under which the proper compression is achieved, an improper compression loss is caused by an over compression or insufficient compression. Therefore, scroll compressors used for applications in a wide operation range are required to reduce the improper compression loss as an important object.

In order to reduce the over-compression loss, there has been proposed a scroll compressor having sub-discharge ports (relief ports) for discharge from a compression chamber (intermediate chamber) at the time at which a pressure in the intermediate chamber reaches a discharge pressure before an innermost chamber in which a discharge port is open and the intermediate chamber, which is located outward of the innermost chamber, communicate with each other (see, for example, Patent Literature 1).

CITATION LIST

Patent Literature

Patent Literature 1: Japanese Unexamined Patent Application Publication No. 2007-170253

SUMMARY OF INVENTION

Technical Problem

In a scroll compressor disclosed in Patent Literature 1, a volute-side opening of each of relief ports is formed to have a circular shape. Therefore, in order to ensure a necessary volute-side opening area or necessary volute-side opening intervals to obtain a sufficient over-compression loss reduction effect, a diameter of the opening formed in the circular shape is required to be increased. Where the diameter of the opening is greater than a scroll tooth thickness or a width of a seal, and the volute-side opening portion of each of the relief ports extends across the scroll tooth thickness or the seal, there is a possibility that the relief port works as a bypass passage between adjacent compression chambers (for example, the innermost chamber and the intermediate chamber) which are different in pressure from each other. As a result, a compressor efficiency may be reduced because of a refrigerant leakage, especially, in an operating region in which the over compression does not occur is a concern.

The present invention has been made to solve the problem described above, and an object of the invention is to provide a scroll compressor having a configuration which can minimize a refrigerant leakage loss caused by arrangement of sub-discharge ports, while obtaining a necessary over-compression reduction effect.

Solution to Problem

According to one embodiment of the present invention, there is provided a scroll compressor, including: an orbiting scroll including an orbiting-scroll base plate and an orbiting-scroll volute provided upright on the orbiting-scroll base plate; and a fixed scroll including a fixed-scroll base plate and a fixed-scroll volute provided upright on the fixed-scroll base plate, the fixed-scroll base plate including a sub-discharge port configured to cause any one of a first compression chamber and a second compression chamber of a compression chamber, which is formed by combining the fixed-scroll volute and the orbiting-scroll volute, to communicate with a discharge side, the first compression chamber being defined by an inward-facing surface of the fixed-scroll volute and an outward-facing surface of the orbiting-scroll volute, the second compression chamber being defined by an outward-facing surface of the fixed-scroll volute and an inwardly-faced surface of the orbiting-scroll volute, wherein each of the orbiting-scroll volute and the fixed-scroll volute has involute curves, wherein an opening portion of the sub-discharge port on the compression chamber side has a pair of side portions and a pair of connecting portions connecting the pair of side portions, the pair of side portions extending in a circumferential direction of a volute shape of each of the fixed-scroll volute and the orbiting-scroll volute, and each having an involute curve, the connecting portions extending in a radial direction of the volute shape, and wherein a length of each of the pair of side portions of the opening portion in a circumferential direction of the volute shape is greater than a length of each of the pair of connecting portions in a radial direction of the volute shape, and a distance between the opening portion and the inward-facing surface or the outward-facing surface of the fixed-scroll volute and the length of the each of the pair of connecting portions in the radial direction of the volute shape are determined to prevent the first compression chamber and the second compression chamber from communicating with each other in any phase during one revolution of the orbiting scroll.

Advantageous Effects of Invention

In the scroll compressor according to one embodiment of the present, in the opening portion of the sub-discharge port, the distance between the opening portion and the inward-facing surface or the outward-facing surface of the fixed-scroll volute and the length of the each of the pair of connecting portions in the radial direction of the volute shape are determined so as not to cause the first compression chamber and the second compression chamber to communicate with each other in any phase during one revolution of the orbiting scroll. Therefore, the sub-discharge ports can be prevented from working as bypass passages between the adjacent compression chambers which are different from each other in pressure during the rotation of the orbiting scroll. Further, in the opening portion of each of the sub-discharge ports on the compression chamber side, the pair of side portions extending in the circumferential direction of the volute shape is formed longer than the pair of connecting portions extending in the radial direction of the volute shape. As a result, a necessary opening area and a necessary opening interval of each of the sub-discharge ports can be ensured. Therefore, a necessary over-compression loss reduction effect can be obtained while a refrigerant leakage loss via the sub-discharge ports is minimized. Thus, efficiency of the scroll compressor can be improved.

DESCRIPTION OF EMBODIMENTS

Embodiments of a scroll compressor according to the present invention will be described in detail with reference to the drawings. It should be noted that the present invention is not limited by the embodiments described below. Further, in each of the drawings, there is a case where the size of each component differ from that of an actual device.

Embodiment 1

Figure 1:
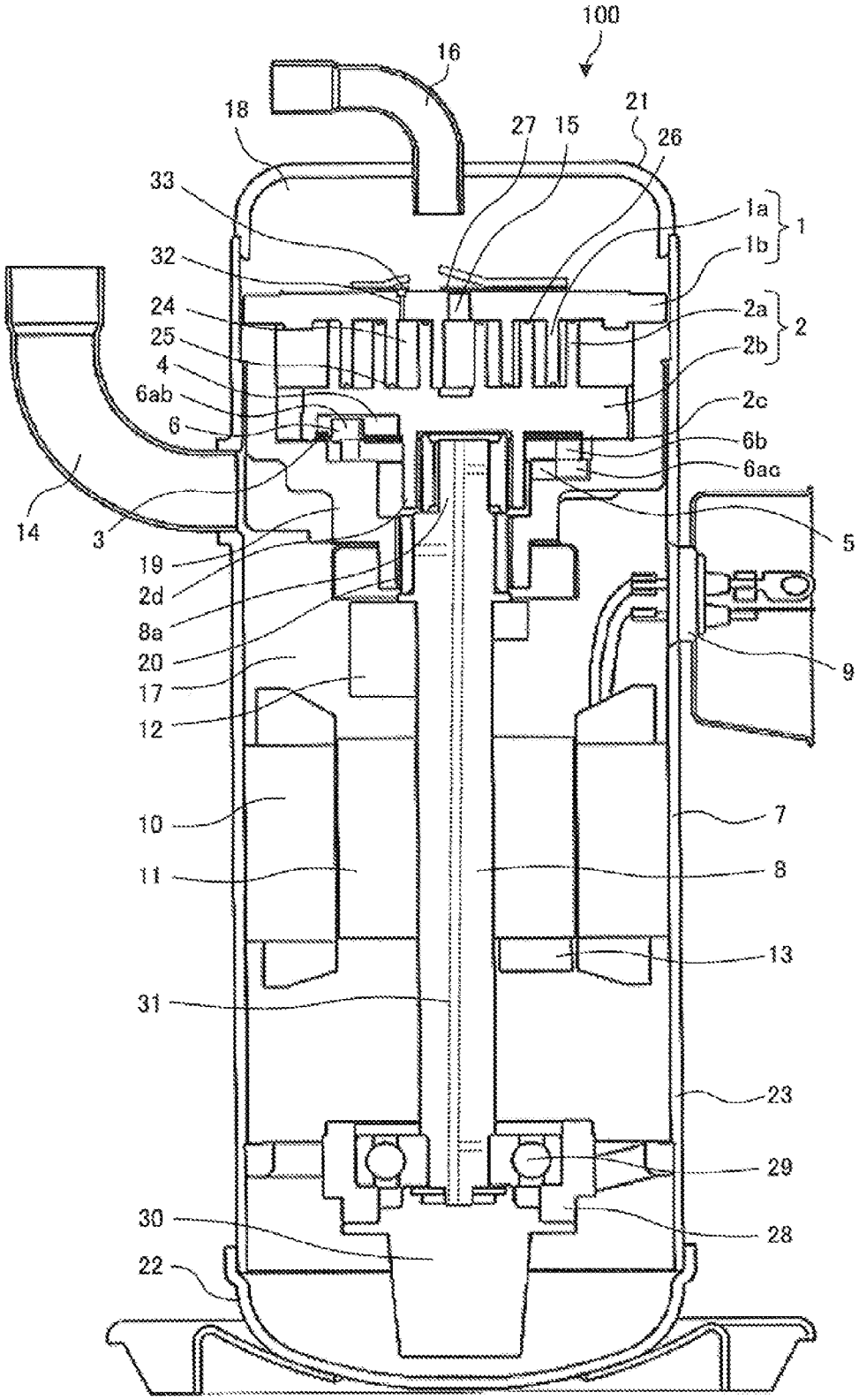
FIG. 1 is a schematic longitudinal sectional view for schematically illustrating an overall structure of a scroll compressor according to Embodiment 1 of the present invention.

FIG. 1 is a schematic longitudinal sectional view for schematically illustrating an overall structure of a scroll compressor according to Embodiment 1 of the present invention. With reference to FIG. 1, a configuration and an operation of a scroll compressor 100 will be described. The scroll compressor 100 is one of structural elements of a refrigeration cycle for use in various industrial machines, for example, refrigerators, freezers, automatic vending machines, air-conditioning apparatus, refrigerating devices, and water heaters.

The scroll compressor 100 is configured to take in refrigerant which circulates in a refrigeration cycle, compress the refrigerant to a high-temperature and a high-pressure state and discharge the refrigerant. The scroll compressor 100 includes an airtight container 23 including a center shell 7, an upper shell 21, and a lower shell 22. The airtight container 23 includes a compression mechanism therein, which is a combination of a fixed scroll 1 and an orbiting scroll 2 which orbits with respect to the fixed scroll 1. Further, a rotational driving unit comprising an electric rotating machine or other devices is provided in the airtight container 23. As illustrated in FIG. 1, the compression mechanism is provided on an upper side, and the rotational driving unit is provided on a lower side inside the airtight container 23.

The airtight container 23 includes the upper shell 21 provided above the center shell 7 and the lower shell 22 provided below the center shell 7. The lower shell 22 serves as an oil reservoir which stores lubricating oil. A suction pipe 14 configured to take in a refrigerant gas therethrough is connected to the center shell 7. A discharge pipe 16 configured to discharge the refrigerant gas is connected to the upper shell 21. An interior of the center shell 7 forms a low-pressure chamber 17, whereas that of the upper shell 21 forms a high-pressure chamber 18.

With reference to FIG. 1, a configuration of the fixed scroll and a configuration of the orbiting scroll of the scroll compressor according to Embodiment 1 will be described. The fixed scroll 1 includes a fixed-scroll base plate 1*b* and a fixed-scroll volute 1*a* which is a volute projection provided upright on one surface of the fixed-scroll base plate 1*b*. The orbiting scroll 2 includes an orbiting-scroll base plate 2*b* and an orbiting-scroll volute 2*a* which is a volute projection provided upright on one surface of the orbiting-scroll base plate 2*b*. The fixed-scroll volute 1*a* and the orbiting-scroll volute 2*a* are volute projections having substantially the same shape. Another surface of the orbiting-scroll base plate 2*b* (a surface on the opposite side of the surface on which the orbiting-scroll volute 2*a* is formed) is an orbiting-scroll thrust bearing surface 2*c*. The orbiting scroll 2 and the fixed scroll 1 are accommodated in a frame 19 including a refrigerant suction port.

In the orbiting scroll 2, a thrust bearing load acting during an operation of the scroll compressor 100 is supported by the frame 19, with the orbiting-scroll thrust bearing surface 2*c* interposed between them. A thrust plate 3 is provided between the frame 19 and the orbiting-scroll thrust bearing surface 2*c* in order to improve slidability.

The orbiting scroll 2 and the fixed scroll 1 are mounted in the airtight container 23, with the orbiting-scroll volute 2*a* and the fixed-scroll volute 1*a* combined with each other. When the orbiting scroll 2 and the fixed scroll 1 are combined with each other, a volute direction of the fixed-scroll volute 1*a* and that of the orbiting-scroll volute 2*a* are opposite to each other. A compression chamber 24 having a variable volume is formed between the orbiting-scroll volute 2*a* and the fixed-scroll volute 1*a*. In the fixed scroll 1 and the orbiting scroll 2, in order to reduce refrigerant leakage from a distal end surface of the fixed-scroll volute 1*a* and a distal end surface of the orbiting-scroll volute 2*a*, a seal 25 to be in contact with the orbiting scroll 2 is disposed on a surface of the fixed-scroll volute 1*a*, which is opposite to the orbiting scroll 2, and a seal 26 to be in contact with the fixed scroll 1 is disposed on a surface of the orbiting-scroll volute 2*a*, which is opposite to the fixed scroll 1.

The fixed scroll 1 is fixed to the frame 19 with bolts or other components. A discharge port 15 and sub-discharge ports 32 for discharging the refrigerant gas which is compressed to have a high pressure are formed in the fixed-scroll base plate 1*b* of the fixed scroll 1. Then, the refrigerant gas which is compressed to have the high pressure is exhausted to the high-pressure chamber 18 provided above the fixed scroll 1 through the discharge port 15 and the sub-discharge ports 32. The refrigerant gas exhausted to the high-pressure chamber 18 is discharged to the refrigeration cycle through the discharge pipe 16. A discharge valve 27 configured to prevent backflow of the refrigerant from the high-pressure chamber 18 toward the discharge port 15 is provided at the discharge port 15. A sub-discharge valve 33 configured to prevent backflow of the refrigerant from the high-pressure chamber 18 toward the sub-discharge port 32 is provided at each of the sub-discharge ports 32.

The orbiting scroll 2 performs orbital movement with respect to the fixed scroll 1 without performing rotating movement, by use of an Oldham ring 6 which is configured to cause the orbital movement to be performed while preventing the rotating movement. Further, a boss portion 2*d* having a hollow cylindrical shape is formed in an approximately center portion of a surface of the orbiting scroll 2, which is on the opposite side of the surface on which the orbiting-scroll volute 2*a* is formed. An eccentric shaft portion 8*a* provided to an upper end of a main shaft 8 is inserted into the boss portion 2*d*.

A pair of Oldham key grooves is respectively formed on a surface of the frame 19 and a surface of the orbiting scroll 2, which are opposite to each other. The Oldham ring 6 is provided in a space defined by the Oldham key groove of the frame 19 and the Oldham key groove of the orbiting scroll 2. An Oldham key 6*ac* to be inserted into the Oldham key groove of the frame 19 is formed on a lower surface of a ring portion 6*b* of the Oldham ring, and an Oldham key 6*ab* to be inserted into the Oldham key groove of the orbiting scroll 2 is formed on an upper surface thereof. The Oldham key 6*ac* is fitted in an Oldham key groove 5, and the Oldham key 6*ab* is fitted in an Oldham key groove 4 of the orbiting scroll. The Oldham key groove 4 and the Oldham key groove 5 are filled with a lubricant. The Oldham key 6*ac* and the Oldham key 6*ab* transmit a rotating force of a motor to the orbiting scroll 2 which is performing the orbital movement while moving forward and backward over sliding surfaces respectively formed in the Oldham key grooves.

The rotational driving unit includes: the main shaft 8, which serves as a rotational shaft; a rotor 11 fixed to the main shaft 8; and a stator 10. The stator 10 is fixed by shrink-fitting to the center shell 7. The rotor 11 is fixed to the main shaft 8 by shrink-fitting and is rotationally driven by starting energization of the stator 10 to rotate the main shaft 8. Specifically, the stator 10 and the rotor 11 form the electric rotating machine. The stator 10 and the rotor 11 are arranged below a first balance weight 12 fixed to the main shaft 8. The first balance weight 12 will be described later. The stator 10 is supplied with electric power through a power supply terminal 9 provided at the center shell 7.

The main shaft 8 is rotated in accordance with the rotation of the rotor 11, and is configured to orbit the orbiting scroll 2. An upper part of the main shaft 8, that is, a portion thereof which is located in the vicinity of the eccentric shaft portion 8*a*, is supported by a main bearing 20 provided at the frame 19. A lower portion of the main shaft 8 is rotatably supported by a sub-bearing 29. The sub-bearing 29 is press-fitted and fixed in a bearing accommodating portion formed in a central portion of a sub-frame 28 provided in a lower part of the airtight container 23. A displacement type oil pump 30 is provided at the sub-frame 28. The lubricating oil taken in by the oil pump 30 is transmitted to each sliding portion through an oil feed hole 31 formed in the main shaft 8.

The first balance weight 12 is provided at the upper part of the main shaft 8 to cancel out unbalance which is caused by orbital movement of the orbiting scroll 2 which is made when the orbiting scroll 2 is mounted on the eccentric shaft portion 8*a*. A second balance weight 13 is provided at a lower part of the rotor 11 to cancel out the unbalance which is caused by the orbital movement of the orbiting scroll 2 which is made when the orbiting scroll 2 is mounted on the eccentric shaft portion 8*a*. The first balance weight 12 is fixed to the upper part of the main shaft 8 by shrink-fit, and the second balance weight 13 is fixed to the lower part of the rotor 11 such that the second balance weight 13 and the rotor 11 are provided as a single body.

Next, an operation of the scroll compressor 100 will be described. When the power supply terminal 9 is energized, a current flows through an electric wire portion of the stator 10 to produce a magnetic field. The magnetic field acts to rotate the rotor 11. Specifically, a torque is produced between the stator 10 and the rotor 11 to rotate the rotor 11. When the rotor 11 rotates, the shaft 8 is rotationally driven in accordance with the rotation. The orbiting scroll 2, which is prevented from being rotated by a configuration of the Oldham ring 6 described above, performs orbital movement when the shaft 8 is rotationally driven.

When the rotor 11 rotates, with respect to eccentric orbital movement of the orbiting scroll 2, balance is maintained by the first balance weight 12 fixed to the upper part of the main shaft 8 and the second balance weight 13 fixed to the lower part of the rotor 11. In this manner, the orbiting scroll 2 eccentrically supported on the upper part of the main shaft 8, which is prevented from being rotated by the Oldham ring 6, starts performing the orbital movement to compress the refrigerant based on a known compression principle.

As a result, part of the refrigerant gas flows into the compression chamber 24 through the frame refrigerant suction port formed in the frame 19 to start a suction process. The remaining part of the refrigerant gas passes through a cutout (not shown) formed in a steel plate of the stator 10 to cool the lubricating oil and the electric rotating machine formed by the stator 10 and the rotor 11. The compression chamber 24 is moved toward a center of the orbiting scroll 2 by the orbital movement of the orbiting scroll 2, as a result of which the volume of the compression chamber 24 is reduced. Through the above-mentioned process, the refrigerant gas taken in the compression chamber 24 is gradually compressed. The compressed refrigerant passes through the discharge port 15 of the fixed scroll 1, pushes and opens the discharge valve 27, and then flows into the high-pressure chamber 18. Further, the compressed refrigerant passes through the sub-discharge ports 32 of the fixed scroll 1, pushes and opens the sub-discharge valves 33, and then flows into the high-pressure chamber 18. The refrigerant flowing into the high-pressure chamber 18 is discharged from the airtight container 23 through the discharge pipe 16.

The thrust bearing load applied by a pressure of the gas refrigerant in the compression chamber 24 is received by the frame 19 which supports the orbiting-scroll thrust bearing surface 2*c*. A centrifugal force and a refrigerant gas load which are applied to the first balance weight 12 and the second balance weight 13 by the rotation of the main shaft 8 are received by the main bearing 20 and the sub-bearing 29. A low-pressure refrigerant gas in the low-pressure chamber 17 and the high-pressure refrigerant gas in the high-pressure chamber 18 are separated from each of her by the fixed scroll 1 and the frame 19 to keep airtightness. When the energization of the stator 10 is stopped, the scroll compressor 100 stops the operation.

Figure 2:
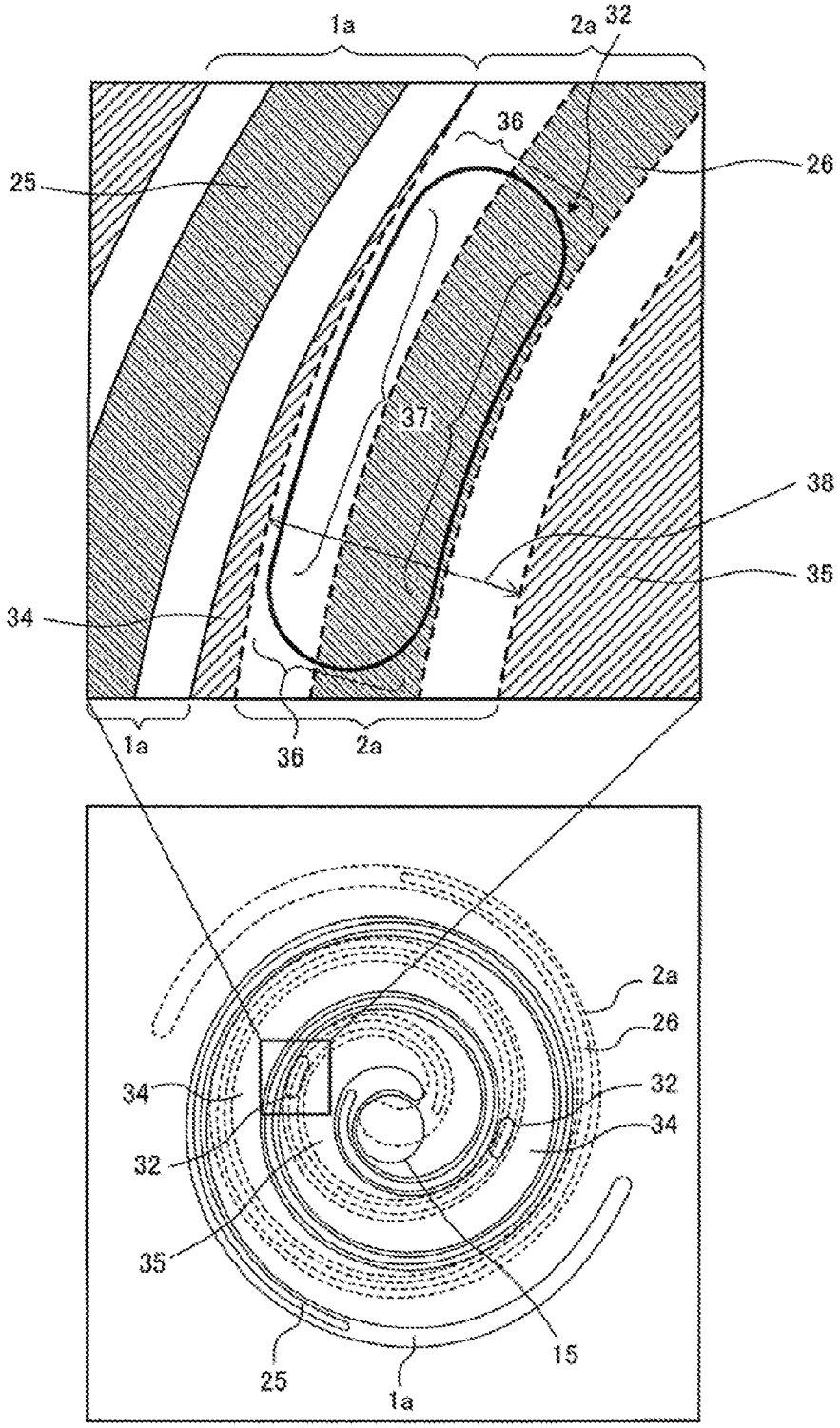
FIG. 2 is a planar volute shape view for illustrating a volute shape of a fixed scroll, a volute shape of an orbiting scroll, and sub-discharge ports of the scroll compressor according to Embodiment 1 of the present invention.

FIG. 2 is a planar volute shape view for illustrating a volute shape of the fixed scroll, a volute shape of the orbiting scroll, and the sub-discharge ports of the scroll compressor according to Embodiment 1 of the present invention. In part of the figure which illustrates the entire volute plane, the fixed-scroll volute 1*a* is indicated by the solid line and the orbiting-scroll volute 2*a* is indicated by the broken line to clearly illustrate the fixed-scroll volute 1*a* and the orbiting-scroll volute 2*a*. Further, in part of the figure which enlargedly illustrates a part of the volute plane, a region of each portion is hatched as appropriate to be clearly defined. With reference to FIG. 2, a structure of the fixed-scroll volute 1*a* of the fixed scroll 1 and that of the orbiting-scroll volute 2*a* of the orbiting scroll 2 will be described in detail. In FIG. 2, the fixed-scroll volute 1*a* and the orbiting-scroll volute 2*a* are illustrated as viewed from a lower side (a side on which the lower shell is located) of the scroll compressor 100. In order that the seal 25 and the position of the seal 25 be clearly illustrated, they are indicated by respective solid lines.

As described above, the compressor 24 is formed by the combination of the fixed-scroll volute 1*a* and the orbiting-scroll volute 2*a*. The intermediate chamber 34 (first compression chamber) of the compressor 24 is defined by an inward-facing surface of the fixed-scroll volute 1*a* and an outward-facing surface of the orbiting-scroll volute 2*a*. An innermost chamber 35 (second compression chamber) of the compression chamber 24 is defined by an outward-facing surface of the fixed-scroll volute 1*a* and an inward-facing surface of the orbiting-scroll volute 2*a*. In Embodiment 1, each of the outward-facing surface of the inward-facing surface of the fixed-scroll volute 1*a* has an involute curve. Similarly, each of the outward-facing surface of the inward-facing surface of the orbiting-scroll volute 2*a* has an involute curve. The "outward-facing surface" is a surface facing an outer edge side of the volute shape, whereas the "inward-facing surface" is a surface facing the center of the volute shape.

As described above, in order to prevent refrigerant leakage, the seal 25 is disposed on the distal end surface of the fixed-scroll volute 1*a*, and the seal 26 is disposed on the distal end surface of the orbiting-scroll volute 2*a*. Each of an outer peripheral edge and an inner peripheral edge of the seal 25 has an involute curve. Similarly, each of an outer peripheral edge and an inner peripheral edge of the seal 26 has an involute curve. The "outer peripheral edge" is an edge portion facing the outer edge side of the volute shape, whereas the "inner peripheral edge" is an edge portion facing the center of the volute shape.

An opening portion of each of the sub-discharge ports 32, which is located on a volute side located opposite to the sub-discharge valve 33 (an opening portion on the compression chamber 24 side; hereinafter referred to as "volute-side opening portion") has an elongated hole shape. The volute-side opening portion has a pair of involute curve portions 37 extending in a circumferential direction of the volute shape and a pair of arc-shaped portions 36 extending in a radial direction of the volute shape, the pair of arc-shaped portions 36 connecting the pair of involute curve portions 37. In each of the sub-discharge ports 32, a position at which the volute-side opening portion is formed and a length of each of the arc-shaped portions 36 in the radial direction of the volute shape are determined such that that the volute-side opening portion does not extend across the seal 26 disposed on the distal end surface of the orbiting-scroll volute 2*a* in any phase during one revolution of the orbiting-scroll 2, that is, the volute-side opening portion is not located on the center side of the volute beyond the inner peripheral edge of the seal 26 in any phase during one revolution of the orbiting-scroll 2. In other words, a distance between the volute-side opening portion and the inwardly-oriented edge of the seal 26 and the length of each of the pair of arc-shaped portions 36 in the radial direction of the volute shape are determined such that the intermediate chamber 34 and the innermost chamber 35 are not caused to communicate with each other in any phase during one revolution of the orbiting scroll 2. Further, the volute-side opening portion of each of the sub-discharge ports 32 is formed such that a length of each of the involute curve portions 37 in the circumferential direction of the volute shape is greater than the length of each of the arc-shaped portions 36 in the radial direction of the volute shape.

With the configuration described above, it is possible to prevent, during the driving of the orbiting scroll 2, a refrigerant leakage, which would occur if the sub-discharge ports 32 extend across the seal 26 to work as the bypass passage between the adjacent compression chambers which are different from in pressure (between the innermost chamber 35 and the intermediate chamber 34 in Embodiment 1), and also ensure a necessary volute-side opening area and necessary volute-side opening intervals. Therefore, a necessary over-compression loss reduction effect can be obtained while a loss caused by the refrigerant leakage via the sub-discharge ports 32 is minimized. As a result, the compression efficiency in the scroll compressor 100 can be improved.

Embodiment 2

Figure 3:
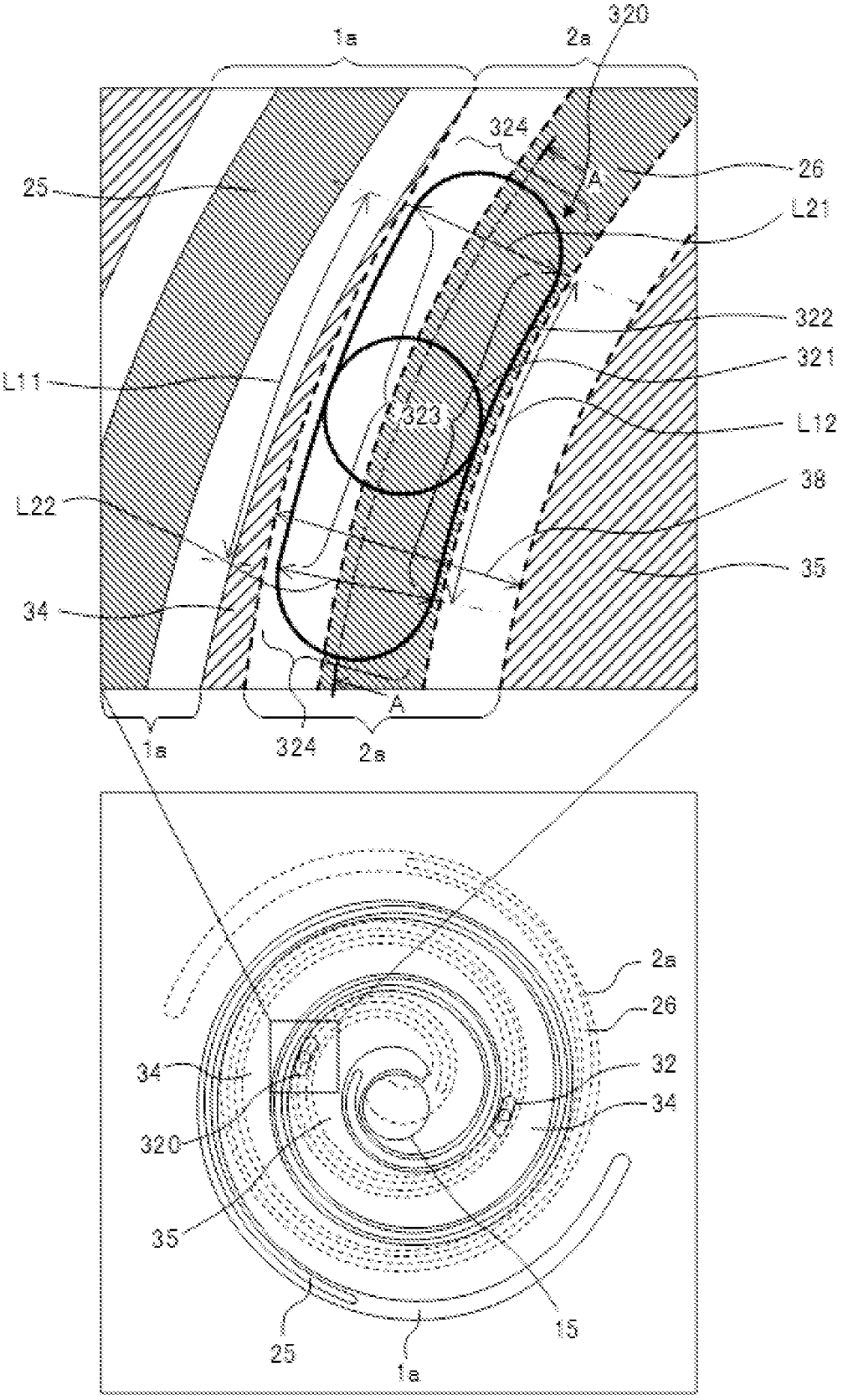
FIG. 3 is a planar volute shape view for illustrating the volute shape of the fixed scroll, the volute shape of the orbiting scroll, and sub-discharge ports of the scroll compressor according to Embodiment 2 of the present invention.
Figure 4:
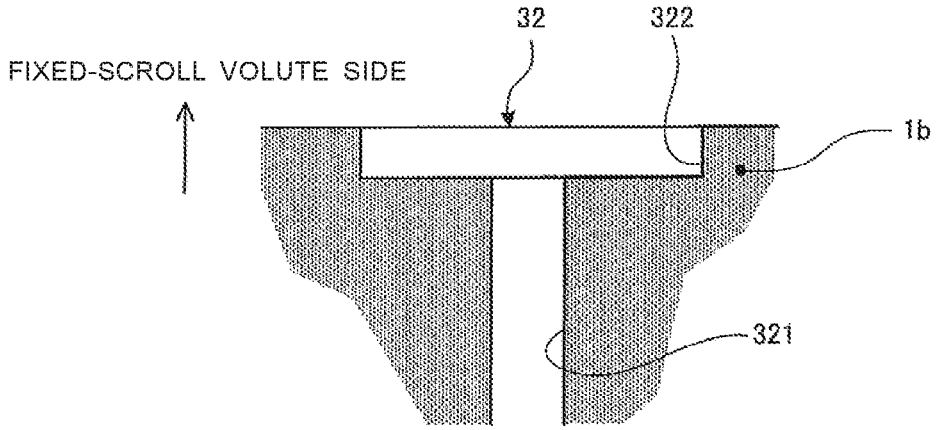
FIG. 4 is a sectional view taken along line A-A indicated by arrows in FIG. 3.
Figure 5:
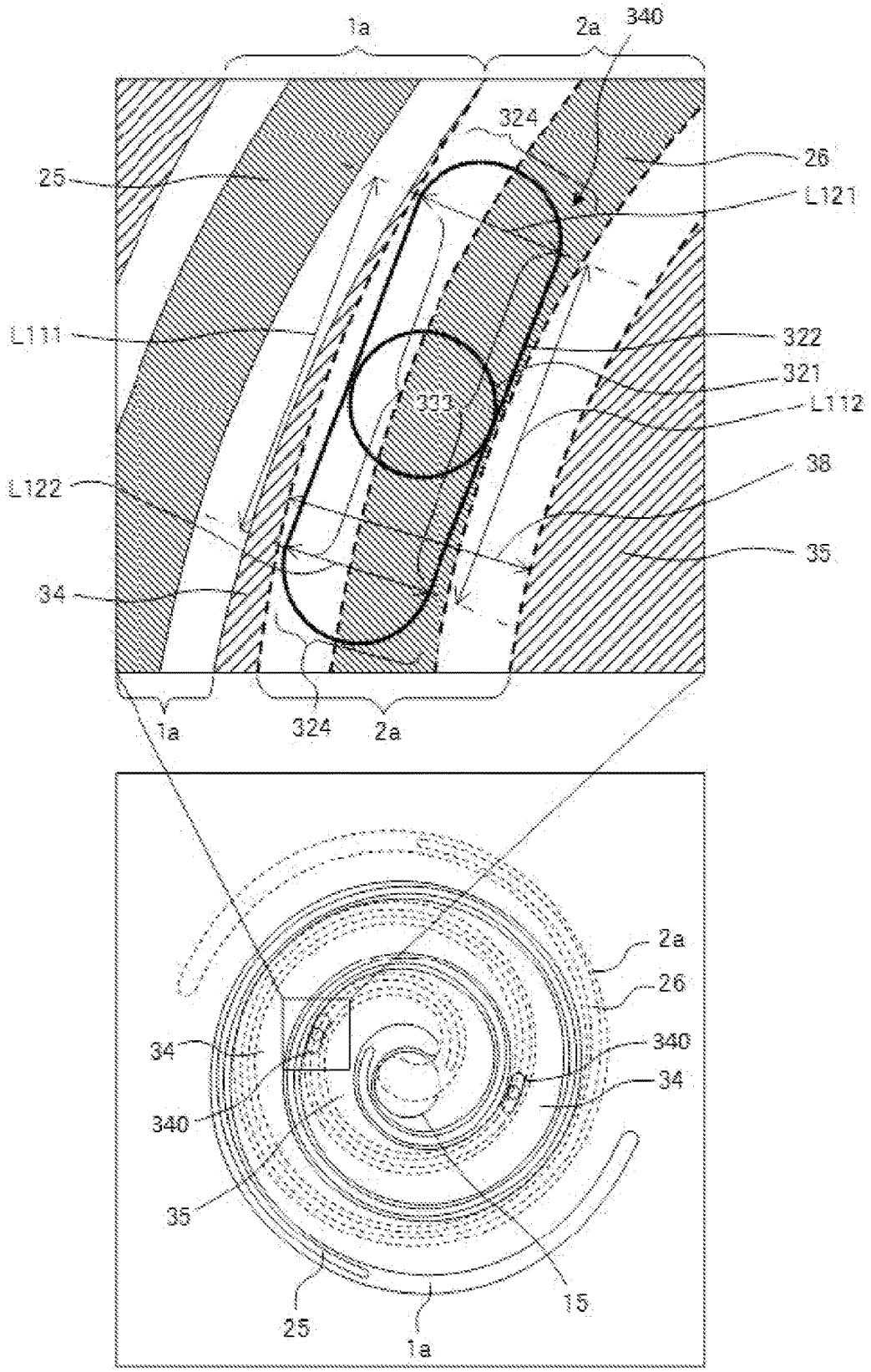
FIG. 5 is a planar volute shape view for illustrating the volute shape of the fixed scroll, the volute shape of the orbiting scroll, and sub-discharge ports of the scroll compressor according to a modification of Embodiment 2 of the present invention.

FIGS. 3 and 5 show a planar volute shape view for illustrating a volute shape of the fixed scroll, a volute shape of the orbiting scroll, and the sub-discharge ports of the scroll compressor according to Embodiment 2 of the present invention. FIG. 4 is a sectional view taken along the arrow A-A of FIG. 3. In part of FIGS. 3 and 5 which illustrates the entire volute plane, the fixed-scroll volute 1*a* is indicated by a solid line and the orbiting-scroll volute 2*a* is indicated by a broken line to clearly illustrate the fixed-scroll volute 1 and the orbiting-scroll volute 2*a*. Further, in part of the figures which enlargedly illustrates a part of the volute plane, a region of each portion is hatched as appropriate to be clearly defined.

Each of sub-discharge ports 320 according to Embodiment 2 has a compression-chamber-side end portion 322 which is open to the compression chamber 24 side and a base portion 321 which is continuous with the compression chamber-side end portion 322 and is open to the high-pressure chamber 18. The compression chamber-side end portion 322 is an end portion located on the fixed-scroll volute 1*a* side of the fixed scroll 1, and has a predetermined height from the compression chamber 24 side along an axial direction of each of the sub-discharge ports 320. A section of the compression chamber-side end portion 322 has a pair of involute curve portions 323 extending in the circumferential direction of the volute shape by a length L11, L12 and a pair of arc-shaped portions 324 extending in the radial direction of the volute shape by a length L21, L22, the pair of arc-shaped portions 324 connecting the pair of involute curve portions 323, as in the volute-side opening portion of each of the sub-discharge ports 32 of Embodiment 1. A section of the base portion 321 is circular and has a diameter which is approximately the same as a length of each of the arc-shaped portions 324 of the compression chamber-side end portion 322 in the radial direction of the volute shape. Specifically, the section of the base portion 321 is smaller than that of the compression chamber-side end portion 322.

Embodiment 2 differs from Embodiment 1 in that only the compression chamber-side end portion 322 has the section formed with the pair of arc-shaped portions 36 and the pair of involute curve portions 37, and the section of the base portion 321 is shaped in a circle smaller than the section of the compression chamber-side end portion 322.

With the configuration described above, when a necessary opening area of each of the sub-discharge ports 32 can be ensured with a circular area of the base portion 321, the necessary volute-side opening intervals of the sub-discharge ports can be ensured while reducing the amount of a refrigerant leakage which occurs when the sub-discharge ports 32 are moved between the compression chambers (from the innermost chamber 35 to the intermediate chamber 34 in Embodiment 2) differing from in pressure, while reducing the flow passage volume of each of the sub-discharge ports 32. As a result, the necessary over-compression loss reduction effect can be obtained while the refrigerant leakage loss via the sub-discharge ports 32 is minimized. As a result, the efficiency of the scroll compressor can be improved.

In Embodiments 1 and 2, the seal 25 is disposed on the distal end surface of the fixed-scroll volute 1*a* and the seal 26 is disposed on the distal end surface of the orbiting-scroll volute 2*a*. However, the configuration is not limited to such a configuration. The distance between the volute-side opening portion and the inward-facing surface or the outward-facing surface of the fixed-scroll volute 1*a* the length of each of the pair of arc-shaped portions 36 in the radial direction of the volute shape may be determined in accordance with the positions at which the sub-discharge ports 32 are formed, such that the intermediate chamber 34 and the innermost chamber 35 are not caused to communicate with each other in any phase during one revolution of the orbiting scroll 2. Specifically, the sub-discharge ports 32 may be configured such that the volute-side opening portion of each of the sub-discharge ports 32 does not extend across a tooth thickness 38 of the orbiting-scroll volute 2*a* in any phase during one revolution of the orbiting scroll 2, that is, such that the sub-discharge port 32 is not displaced to the innermost chamber 35 located on the center side of the volute shape beyond the inward-facing surface of the orbiting-scroll volute 2*a*, and it is not displaced to the intermediate chamber 34 located on the outer edge side of the volute shape beyond the outward-facing surface of the orbiting-scroll volute 2*a*. With the configuration described above, the seal 25 and the seal 26 can be omitted.

In Embodiment 2, the section of the compression chamber-side end portion 322 of each of the sub-discharge ports 320 has the involute curve portions 323 and the arc-shaped portions 324. However, the section is not limited to such a section. It may have a circular shape, an oval shape, or an elongated hole shape having linear portions in place of the involute curve portions 323. An example of the elongated hole shape having linear portions is provided in FIG. 5. FIG. 5 shows a sub-discharge port 340 that has a pair of straight-line side portions 333 instead of the pair of involute curve portions 323 shown in the sub-discharge port 320 of FIG. 3. The pair of straight-line curve portions 333 extend in the circumferential direction of the volute shape by a length L111, L112, and the pair of arc-shaped portions 324 extend in the radial direction of the volute shape by a length L121, L122.

In Embodiment 1 and Embodiment 2, the opening shape of each of the sub-discharge ports 32, 320 on the high-pressure chamber 18 side, specifically, on the discharge side may be any shape as long as a most-narrowed portion of a flow passage of each of the sub-discharge ports 32, 320 is not formed at the sub-discharge ports 32, 320.

Although refrigerant is not referred to with respect to Embodiment 1 and Embodiment 2, higher effects can be obtained by using high-density refrigerant such as, for example, R32.

REFERENCE SIGNS LIST

1 fixed scroll 1*a* fixed-scroll volute 1*b* fixed-scroll base plate 2 orbiting scroll 2*a* orbiting-scroll volute 2*b* orbiting-scroll base plate 2*c* orbiting-scroll thrust bearing surface 2*d* boss portion 3 thrust plate 4 Oldham key groove 5 Oldham key groove 6 Oldham ring 6*ab* Oldham key 6*ac* Oldham key 6*b* ring portion 7 center shell 8 main shaft 8*a* eccentric shaft portion 9 power supply terminal 10 stator 11 rotor 12 first balance weight 13 second balance weight 14 suction pipe 15 discharge port 16 discharge pipe 17 low-pressure chamber 18 high-pressure chamber 19 frame 20 main bearing 21 upper shell 22 lower shell 23 airtight container compressor 25 seal 26 seal 27 discharge valve 28 sub-frame 29 sub-bearing 30 oil pump 31 oil feed hole 32 sub-discharge port 33 sub-discharge valve 34 intermediate chamber 35 innermost chamber 36 arc-shaped portion 37 involute curve portion 38 tooth thickness 100 scroll compressor 320 sub-discharge port 321 base portion 322 compression chamber-side end portion 323 involute curve portion 324 arc-shaped portion

The invention claimed is:

1. A scroll compressor, comprising:

an orbiting scroll including an orbiting-scroll base plate and an orbiting-scroll volute provided upright on the orbiting-scroll base plate; and a fixed scroll including a fixed-scroll base plate and a fixed-scroll volute provided upright on the fixed-scroll base plate, the fixed-scroll base plate including at least one sub-discharge port configured to cause any one of a first compression chamber and a second compression chamber, which is formed by combining the fixed-scroll volute and the orbiting-scroll volute, to communicate with a discharge side, the fixed-scroll base plate also including a discharge port configured to discharge refrigerant compressed by the first compression chamber or the second compression chamber, the first compression chamber being defined by an inward-facing surface of the fixed-scroll volute and an outward-facing surface of the orbiting-scroll volute, the second compression chamber being defined by an outward-facing surface of the fixed-scroll volute and an inward-facing surface of the orbiting-scroll volute, wherein each of the orbiting-scroll volute and the fixed-scroll volute has involute curves, wherein the sub-discharge port includes: a compression chamber-side end portion formed to maintain a shape of an opening portion on the compression chamber side from the compression chamber side to a predetermined height, and a base portion which is formed continuous with the compression chamber-side end portion and open to the discharge side, the base portion having a smaller sectional area than an opening area of the opening portion in an axial cross-section of the sub-discharge port, wherein a section of the compression chamber-side end portion in a radial cross-section of the sub-discharge port has a pair of side portions and a pair of connecting portions connecting the pair of side portions, the pair of side portions extending in a circumferential direction of a volute shape formed by each of the fixed-scroll volute and the orbiting-scroll volute, the pair of connecting portions extending in a radial direction of the volute shape, and wherein a length of each of the pair of side portions of the compression chamber-side end portion of the opening portion in a circumferential direction of the volute shape is greater than a length of each of the pair of connecting portions in a radial direction of the volute shape, and a distance between the opening portion and the inward-facing surface or the outward-facing surface of the fixed-scroll volute and the length of the each of the pair of connecting portions in the radial direction of the volute shape prevent the first compression chamber and the second compression chamber from communicating with each other in any phase during one revolution of the orbiting scroll.

2. The scroll compressor of claim 1, wherein the orbiting scroll includes a first seal disposed on a surface of the orbiting-scroll volute, which is opposite to the fixed scroll, the first seal being in contact with the fixed scroll, wherein the fixed scroll includes a second seal disposed on a surface of the fixed-scroll volute, which is opposite to the orbiting scroll, the second seal being in contact with the orbiting scroll, wherein each of an outwardly-oriented edge of the first seal, an inwardly-oriented edge of the first seal, an outwardly-oriented edge of the second seal and an inwardly-oriented edge of the second seal has an involute curve, and wherein a distance between the opening portion and the inwardly-oriented edge or the outwardly-oriented edge of the first seal and the length of the each of the pair of connecting portions in the radial direction of the volute shape are determined to prevent the first compression chamber and the second compression chamber from communicating with each other in any phase during the one revolution of the orbiting scroll.

3. The scroll compressor of claim 2, wherein the pair of side portions of the compression chamber-side end portion of the sub-discharge port extends along involute curves of the first seal.

4. The scroll compressor of claim 1, wherein the pair of side portions of the compression chamber-side end portion of the sub-discharge port extends along the involute curves of the orbiting-scroll volute.

5. The scroll compressor of claim 1, wherein each of the pair of side portions of the compression chamber-side end portion of the sub-discharge port has a straight line extending in the circumferential direction of the volute shape.

6. The scroll compressor of claim 1, wherein an opening shape of the opening portion of the sub-discharge port is a circular shape.

7. The scroll compressor of claim 1, wherein an opening shape of the opening portion of the sub-discharge port is an oval shape.

8. The scroll compressor of claim 1, wherein an opening area of the opening portion of the sub-discharge port, which is open to the discharge side, is not smallest among sectional areas of portions of the sub-discharge port in an axial cross section of the sub-discharge port.

9. The scroll compressor of claim 1, wherein refrigerant to be compressed in the compression chamber is R32.

10. The scroll compressor of claim 1, wherein a cross section of the base portion has a circular shape and a diameter equal to a length of each of the pair of side portions of the compression chamber-side end portion in the radial direction of the volute shape.

11. The scroll compressor of claim 1, wherein a plurality of sub-discharge ports including the sub-discharge port are provided.

* * * * *